United States Patent [19]

Neybourger et al.

[11] Patent Number: 4,655,281

[45] Date of Patent: Apr. 7, 1987

[54] HEAT EXCHANGER INCORPORATING A TUBE BUNDLE ARRANGED IN A CYLINDRICAL BUNDLE CASING HELD RADIALLY INSIDE AN OUTER CYLINDRICAL CASING

[75] Inventors: Roger Neybourger, Paris; Christian Olivier, Chatenoy-le-Royal, both of France

[73] Assignee: Framatome & Cie., Courbevoie, France

[21] Appl. No.: 721,349

[22] Filed: Apr. 9, 1985

[30] Foreign Application Priority Data

Apr. 11, 1984 [FR] France ..... 84 05719

[51] Int. Cl.[4] ..... F28D 7/00

[52] U.S. Cl. ..... 165/160; 165/162

[58] Field of Search ..... 165/160, 162

[56] References Cited

U.S. PATENT DOCUMENTS 4,267,020 5/1981 Burack ..... 165/160 X

FOREIGN PATENT DOCUMENTS 2515806 10/1981 France ..... 165/160

2511491 8/1982 France ..... 165/160

2123542 2/1984 United Kingdom ..... 165/160

*Primary Examiner*—Albert W. Davis, Jr.

*Assistant Examiner*—Peggy A. Neils

*Attorney, Agent, or Firm*—Pollock, Vande Sande & Priddy

[57] ABSTRACT

A steam generator incorporating a tube bundle (2) arranged in a bundle casing (5), in which the wall of bundle casing (5) incorporates openings each corresponding to a supporting component (20), openings along the edge of which are fixed sleeves (15) projecting radially into the space between the casing (5) and the outer wall (3) of the heat exchanger. Each of the supporting components (20) incorporates two cylindrical parts situated in extension of one another, a large-diameter part (20*a*) welded by its side surface inside the sleeve (15) and a small-diameter part (20*b*) abutting against the casing (3). Wedges (23) are inserted between the part (20*a*) of the supporting component (20) and a spacer plate (8) of the heat exchanger. The invention applies, in particular, to steam generators of pressurized water nuclear reactors.

6 Claims, 9 Drawing Figures

HEAT EXCHANGER INCORPORATING A TUBE BUNDLE ARRANGED IN A CYLINDRICAL BUNDLE CASING HELD RADIALLY INSIDE AN OUTER CYLINDRICAL CASING

FIELD OF THE INVENTION

The invention relates to a heat exchanger incorporating a tube bundle arranged in a cylindrical bundle casing held radially inside an outer cylindrical casing.

BACKGROUND OF THE INVENTION

Heat exchangers such as steam generators in a pressurized water nuclear reactor incorporate a tube bundle consisting of a very large number of small-diameter tubes arranged vertically inside a bundle casing of a generally cylindrical shape, itself arranged inside the thick rigid outer pressurized casing of the steam generator.

Pressurized water of the nuclear reactor circulates inside the small-diameter tubes and the water to be vaporized is introduced into the bundle casing, where it comes into contact with the outer surface of the tubes. Steam is collected at the top part of the bundle casing and it is then generally dried in steam-water separators arranged in the outer casing of the steam generator above the bundle casing.

The steam generator is fed with water to be vaporized by a means which is generally situated near the top part of the bundle casing. Furthermore, water recovered from the steam by the water-steam separators is also sent back to the bundle casing to be vaporized. A continuous water circulation is thus produced inside the steam generator casing. This circulation may require channelling means such as additional cylindrical casings arranged coaxially with the bundle casing and with the outer casing of the steam generator, solely over a part of their side surface.

The steam generators are very tall units in which the various coaxial casings are arranged with a radial spacing which is generally small.

PRIOR ART

It is known to use spacer plates through which the tubes of the bundle pass and which are distributed along the height of the bundle to hold the tubes in fixed radial positions relative to each other. These spacer plates are linked together by vertical tie rods, the whole being placed inside the bundle casing.

It is therefore important to hold the various coaxial casings of steam generators, and the whole of the bundle, by means of the spacer plates in radial directions, so as to avoid relative movements and impacts between these casings and the bundle in the event of external stresses such as those which accompany an earthquake.

French Pat. No. 2,511,491 discloses devices for holding in radial and axial directions the bundle casing of a steam generator, inside its thicker, rigid outer casing. These holding devices are fixed to the bundle casing, forming several groups each arranged at the level of a spacer plate, the various supporting devices of a group being distributed at the periphery of the spacer plate. These supporting devices consist of components whose thickness is greater than the thickness of the bundle casing and which are fixed in the wall of the latter, locally at the level of the spacer plates. These components are pierced with tapped holes into which can be screwed threaded studs whose end projecting into the space which exists between the bundle casing and the rigid outer casing bears against the inner surface of this outer casing. The devices are placed in the supporting position after the studs have been adjusted, by insertion of wedge-shaped chocking components between the outer edge of the spacer plates and the inner surface of the supporting device which faces the bundle.

Such supporting devices have the disadvantage of occupying much of the width of the space reserved between the bundle casing and the outer casing, and thus appreciably restricting the opening for the passage of water to be vaporized which circulates in this space, without ensuring perfect sealing. These supporting devices also have the disadvantage of making it necessary to insert wedges into slots machined in the peripheral part of the spacer plates. These slots reduce the distance between the peripheral tubes of the bundle and the edge of the spacer plates. When an adequate distance is to be preserved between the peripheral tubes and the plate, the number of the tubes in the bundle must be reduced. Furthermore, the supporting components must have shapes which do not facilitate their being fixed by welding to the wall of the bundle casing.

In the case of a steam generator incorporating several coaxial casings bounding annularly shaped spaces which must be perfectly sealed relative to each other, it is not possible in practice to employ supporting devices such as those described in French Pat. No. 2,511,491, since their use entails a leak hazard.

SUMMARY OF THE INVENTION

The aim of the invention is consequently to offer a heat exchanger incorporating a tube bundle arranged in a cylindrical bundle casing held radially inside an outer cylindrical casing and placed coaxially with the latter, a set of spacer plates arranged transversely relative to the bundle inside the bundle casing and spaced along its length, and several groups of supporting components fixed integrally to the bundle casing, arranged radially at the level of the spacer plates and each inserted between the outer edge of the spacer plates and the inner surface of the outer casing, with interposition of wedging means between the spacer plates and the supporting component, a heat exchanger whose bundle casing is perfectly held in the outer casing by supporting components which form only very limited obstructions to the circulation of fluid in the exchanger, which are perfectly adaptable in the case where the heat exchanger incorporates more than two coaxial casings providing spaces which are perfectly sealed relative to each other and which can be installed simply and rapidly by welding.

To this end:

the bundle casing incorporates openings in its wall, each corresponding to a supporting component, openings at the edge of which are fixed cylindrical sleeves projecting radially into the space between the bundle casing and the outer wall of the heat exchanger, and each of the supporting components incorporates two cylindrical parts having a common axis, one in extension of the other, a large-diameter part welded by its outer lateral surface to the inside of the corresponding sleeve and incorporating a supporting surface for the wedging means, directed towards the tube bundle and sloping radially relative to the axis of the supporting component and a smaller-diameter part intended to abut with its end against the inner surface of the outer casing of the heat exchanger.

BRIEF DESCRIPTION OF THE DRAWINGS

In order that the invention may be more clearly understood, a description will now be given, by way of a non-limiting example, with reference to the attached drawings, of a steam generator of a pressurized water nuclear reactor of the preheating type incorporating devices for radial support of its inner casings.

DETAILED DESCRIPTION

Figure 1:
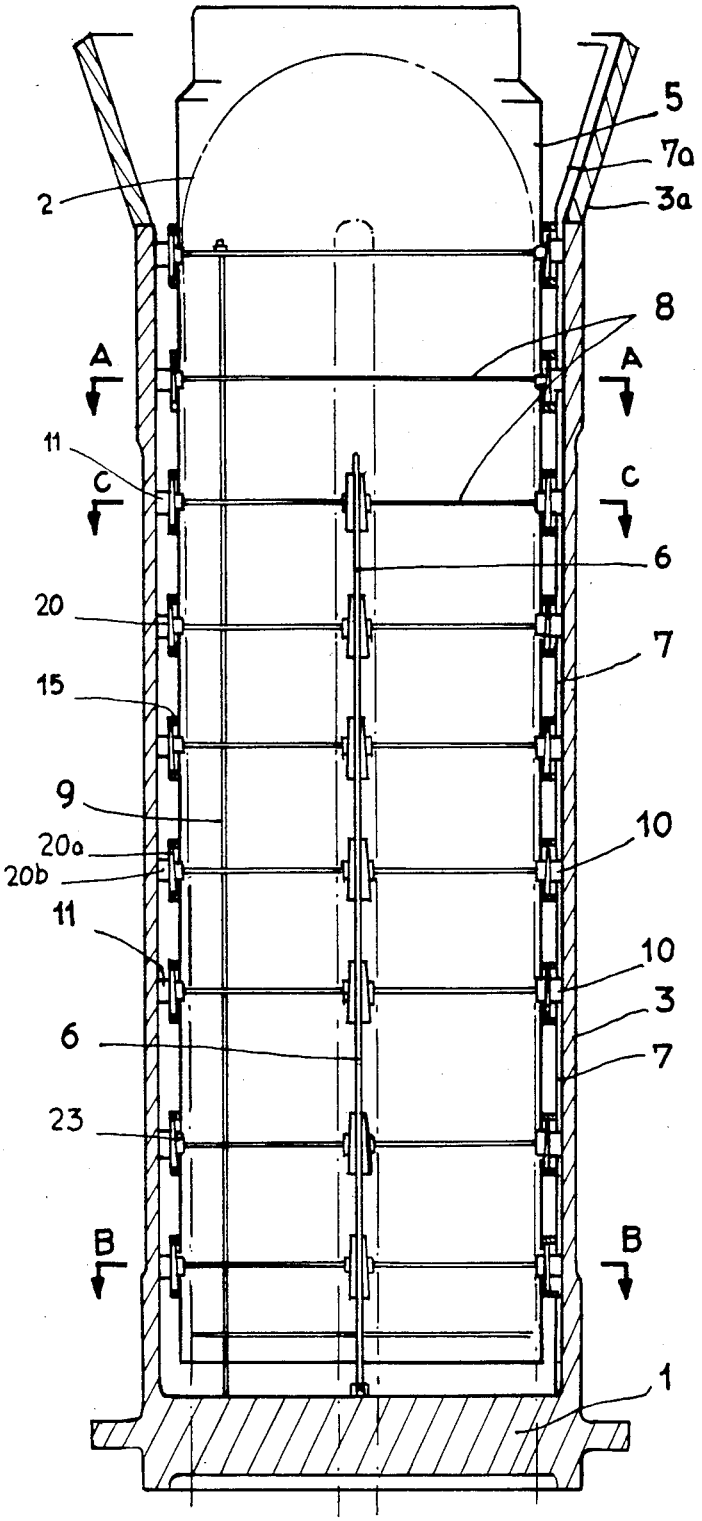
FIG. 1 is a view in cross-section through a vertical plane of symmetry of the central part of a steam generator enclosing the tube bundle.

FIG. 1 shows the central part of a steam generator of a pressurized water nuclear reactor. The steam generator incorporates a tube plate 1 in which are fixed the tubes of the bundle 2, the ends of which open on the lower face of the plate 1. Only the axes of two outermost U-shaped tubes of the bundle have been represented to show the arrangement of this bundle.

The tube plate 1 is fixed integrally at its lower part to a spherical bottom (not shown), forming a chamber in two parts, one of which receives the pressurized water at a high temperature coming from the nuclear reactor and entering the tubes through one of their ends, and the other of which receives the pressurized water which has circulated in the tubes of the bundle 2, before it is returned into the vessel of the nuclear reactor.

The tube plate 1 is integrally fixed by its upper part to the outer casing 3 of the steam generator, which is cylindrical in shape in its central part enclosing the bundle. At its upper part, the cylindrical outer enclosure 3 is connected through its frustoconical part 3*a* to a steam dome, not shown, in which are placed the water-steam separators for drying the steam produced in the steam generator.

The bundle 2 is wholly contained in a bundle casing 5, also cylindrical in shape and arranged inside the outer casing 3 and coaxially with the latter. This bundle casing 5 provides a free space between its lower edge and the upper surface of the tube plate 1. The inner volume of the bundle casing 5 is divided into two parts by a vertical partition 6 over a fraction of its height. The partition 6, arranged along the central space of the tube bundle, outlines in this bundle, up to a certain height, a hot branch which corresponds to the part of the tubes receiving pressurized water coming from the nuclear reactor, and a cold branch which corresponds to the part of the tubes through which the pressurized water leaves the bundle.

Figure 2:
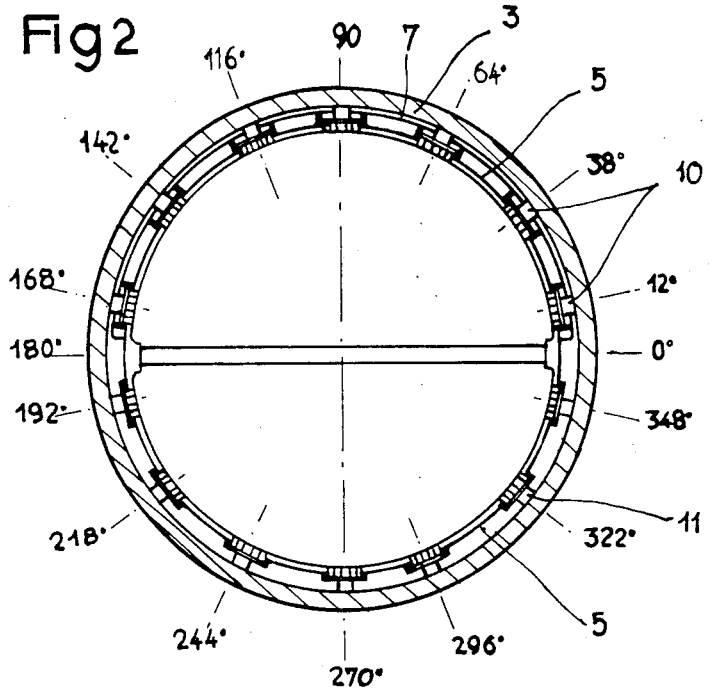
FIG. 2 is a view in cross-section along line A—A or B—B of FIG. 1, showing the supporting devices for the inner casings of the steam generator.
Figure 3:
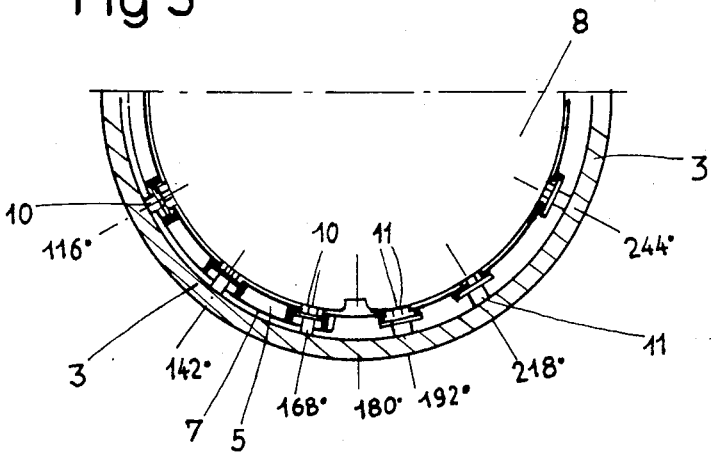
FIG. 3 is a half-view in cross-section of the steam generator along C—C of FIG. 1.

As can be seen in FIGS. 1, 2 and 3, the steam generator incorporates an intermediate casing 7 coaxial with the casings 3 and 5 and arranged between these casings on the part of their circumference which corresponds substantially to the cold branch of the bundle. This intermediate cylindrical casing 7 is connected at its top part to a frustoconical part 7*a* parallel and opposite the frustoconical part 3*a* of the outer casing 3.

The steam generator shown in FIG. 1 is fed with water to be vaporized by feeding means opening into the space bounded by the casings 5 and 7. The space between these casings, which is closed at its ends as can be seen in FIGS. 2 and 3, thus permits the water to be vaporized to be fed only through the base of the cold branch of the bundle. The lower part of the cold branch of the bundle up to the top of the partition 6 thus permits this feed water to be preheated. On the other hand, the water recovered by the separators situated in the steam dome at the top part of the generator returns to the base of the bundle at the same time through the annular space included between the outer casing 3 and the bundle casing 5 and through the annular space included between the intermediate casing 7 and the outer casing 3, both of which communicate with the lower part of the hot branch of the bundle, and through the annular space included between the bundle casing 5 and the intermediate casing 7 which communicates with the lower part of the cold branch of the bundle.

In this manner, the flow of water recovered by the high-temperature separators is subjected to pre-heating only partially.

All of the water which comes into contact with the bundle inside the casing 5 is heated as it circulates upwards in this casing 5 in contact with the tube bundle 2. This water is vaporized and the steam is collected in the top part of the bundle casing 5.

The tubes of the bundle are held laterally by the spacer plates 8 arranged transversely inside the casing 5.

Tie rods 9 fitted at their bottom part on the tube plate 1 make it possible to maintain the axial spacing of the spacer plates 8.

The devices 10 for supporting casings 5 and 7 on the outer casing 3, and the devices 11 for supporting the bundle casing 5 on the outer casing 3 in the part where it is not lined by the intermediate casing 7, are inserted between the edge of the spacer plates 8 and the inner surface of the outer casing 3.

In FIGS. 2 and 3 it can be seen that these supporting devices 10 and 11 are uniformly distributed at the periphery of the spacer plates 8, the radial direction axes of support of two successive devices forming an angle of 26°. Thus, seven supporting devices such as 10 and seven supporting devices such as 11 are arranged around each of the spacer plates. The radial direction axes of support of devices 10 and 11, placed consecutively, form an angle of 24°.

The angular positions of the supporting devices are given in degrees in FIGS. 2 and 3, the axis of symmetry of the spacer plate being taken as a 0°–180° axis.

The supporting devices placed around two upper spacer plates and around the two lower semi-spacer plates (FIG. 2) differ from the supporting devices placed around intermediate spacer plates (FIG. 3) only in the width of the supporting zone and in the number of wedging components between the spacer plate and the supporting component.

Figure 5:
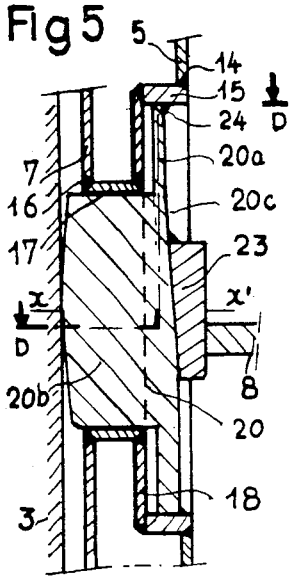
FIG. 5 is a view in cross-section along E—E of FIG. 4.
Figure 4:
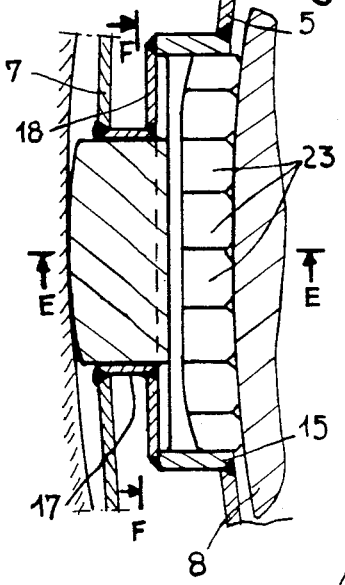
FIG. 4 is a view in cross-section along D—D of FIG. 5, of a supporting device such as shown in FIG. 2.
Figure 6:
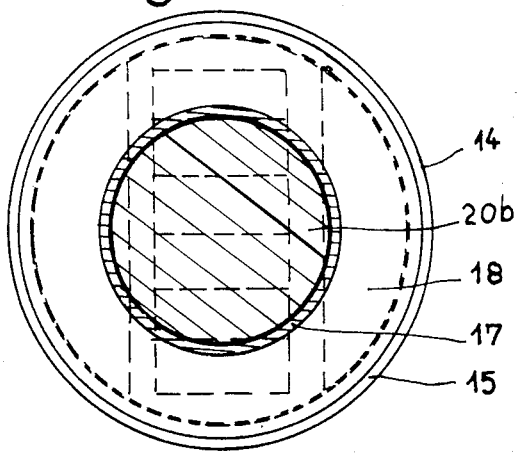
FIG. 6 is a cross-section along F—F of FIG. 4.

FIGS. 4, 5 and 6 show in greater detail a supporting device such as 10 serving to hold radially the bundle casing 5 and the intermediate casing 7 relative to the outer casing 3 of the steam generator. The casing 5 is pierced with openings 14 which correspond to the intersection of the casing 5 with a cylinder whose axis X'X has a radial direction and is substantially at the level of the axis of the spacer plate 8. This axis X'X forms the supporting axis of the device 10. A cylindrical sleeve with a circular base 15, having X'X as its axis, and projecting slightly into the annular space included between the bundle casing 5 and the outer casing 3, is fixed along the openings 14, by welding, on the wall of the bundle casing 5.

Like the casing 5, the intermediate casing 7 has an opening formed by the intersection of casing 7 with a cylinder of axis XX'. Along this opening 16, which is smaller in diameter than the opening 14, a sleeve 17 projecting into the space between the casings 7 and 5 is fixed by welding on the wall of casing 7. An annular plate 18 welded to the free ends of sleeves 15 and 17 enables them to be linked.

The supporting component consists of a single-block component 20 of overall cylindrical shape with axis XX'. This supporting component 20 incorporates a large-diameter part **20*a* whose outer diameter is very slightly smaller than the inner diameter of sleeve 15 and a small-diameter part 20*b* whose outer diameter is very slightly smaller than the inner diameter of sleeve 17**.

The face of the supporting component 20 which is directed towards the inside of the steam generator, i.e., towards the bundle and the spacer plate 8, is machined so as to form a supporting surface **20*c* sloping at an angle of about 5° relative to the vertical. This supporting surface 20*c* is thus sloping in the radial direction relative to the horizontal axis XX'. The angle of inclination of this supporting surface 20*c* corresponds to the angle of machining of the wedges 23 inserted between the spacer plate 8 and the supporting component 20**.

The end of the small-diameter part **20*b* of the component 20 directed towards the inner surface of the outer casing 3 is machined to form a spherical supporting surface between component 20** and this inner surface.

To install the supporting device 10, the supporting component 20 is placed as shown in FIGS. 4 and 5, so that its spherical end surface is in contact with the inner surface of casing 3. A circular weld 24 is then made between the outer side surface of part **20*a* of this component and the inner surface of sleeve 15**. This operation is made easier by the fact that a circular weld of components of revolution is made.

The set of wedges 23 is then placed between the supporting surface **20*c* of component 20 and the outer side edge of spacer plate 8, so as to obtain perfect holding of casing 5 in the radial direction XX' relative to the outer casing 3**.

In the case of the wider supporting components shown in FIG. 2, six wedges placed side by side must be employed to produce the wedging of the supporting component. In the case of the components shown in FIG. 3, which are narrower, only three wedges such as 23 need be employed.

When the wedging has been carried out, the wedges are fixed by welds on the supporting face **20*c* of component 20**.

The radial support of casing 5 is thus obtained by repeating these operations for each of the supporting devices 10 placed at the periphery of each of the spacer plates 8. The supporting devices 10 permit radial support both of the bundle casing 5 and of the intermediate casing 7 which is fixed to casing 5 at the level of the supporting devices by sleeves 17 and 15 and by the annular plate 18. It may also be seen that the space between the casings 5 and 7 remains perfectly isolated from the remainder of the annular space between the bundle casing 5 and the outer casing 3, owing to the fact that the components of revolution are welded over their entire periphery, the supporting component being placed outside this isolated inner space.

The supporting devices 11 between the bundle casing 5 and the outer casing 3, in the part of this casing which is not surrounded by the intermediate casing 7, consist of a supporting component which is identical to the component 20 welded by its large-diameter part to a sleeve which is identical to the cylindrical sleeve 15 fixed at the level of an opening which is identical to the opening 14 in the wall of casing 5. A supporting device 11 comprises the set of components shown in FIGS. 4, 5 and 6, with the exception of sleeve 17 and annular plate 18.

Figure 8:
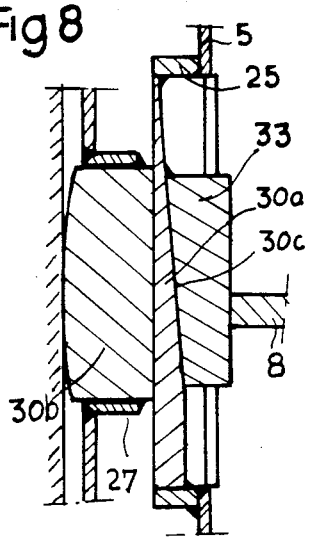
FIGS. 7, 8 and 9 are views similar to views 4, 5 and 6, respectively, of a bearing device according to an alternative embodiment.
Figure 7:
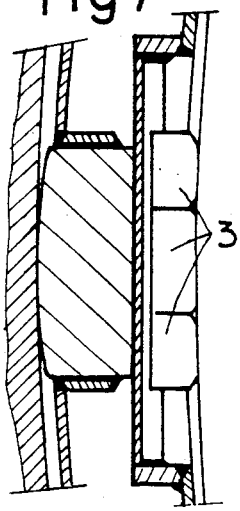
Figure 9:
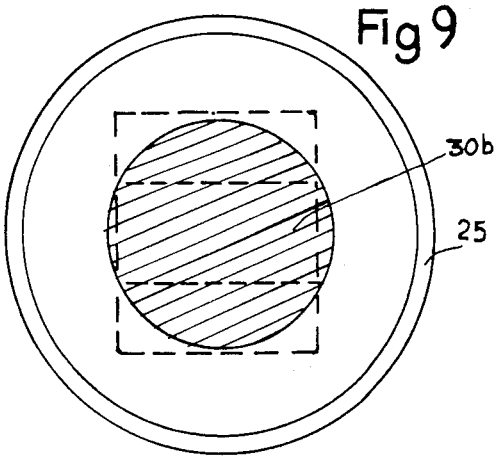

FIGS. 7, 8 and 9 show an alternative embodiment of the supporting component, the latter no longer being in a single block but consisting of two separate components **30*a* and 30*b*. The large-diameter part 30*a* is welded to the inside of a cylindrical sleeve with a circular base 25, itself welded to the casing 5 along an opening in this wall which is identical to the openings 14 of the embodiment shown in FIGS. 4 to 6**.

The small-diameter part **30*b* supported on the inner surface of the outer casing 3 is itself fixed by welding on a cylindrical sleeve with a circular base 27 fixed on the intermediate casing 7 and coaxial with sleeve 25. Components 30*a* and 30*b* support one another by plane faces when wedges 33 are inserted between the outer side edge of the spacer plate 8 and the supporting surface 30*c* sloping relative to the vertical and machined on the face of component 30*a*** directed inwards, is towards the bundle of the steam generator.

During installation, components **30*a* and 30*b* are joined by a circular weld to sleeves 25 and 27, respectively. The support of components 30*a* and 30*b* against the spacer plate 8 and the outer wall 3 is then produced by installing the wedges 33**.

The principal advantages of the heat exchanger according to the invention are that it incorporates devices for supporting, in the radial direction, its inner casings and spacer plates of the bundle on its outer rigid casing, which are extremely efficient and produce only a small disturbance in the circulation of the heat exchanger fluids in the spaces between these casings. In fact, the supporting component incorporates a part with a small cross-section which can extend in the radial direction over most of the space between the casings, the large-diameter part which permits this supporting component to be fixed on the bundle casing being capable of being, on the contrary, reduced in length. Moreover, these supporting devices may be fixed solely with circular welds, which are easy to make. The installation of these supporting devices on the casings is carried out by virtue of cylindrical sleeves and welded annular plates which make it possible to obtain absolutely leakproof connections between the casings, which in turn makes it possible to maintain perfect isolation of the spaces between the casings relative to each other.

The devices for supporting the heat exchanger according to the invention are, furthermore, of such shape that they are adaptable to heat exchangers comprising any number of internal casings.

The supporting components and the wedging components may differ in shape from those which have been described. The number of supporting devices distributed around a spacer plate is unrestricted, each of these supporting devices forming only a small-sized obstacle to the circulation of fluid in the spaces included between the bundle casing and the outer casing of the steam generator.

The shape and distribution of the supporting devices around the spacer plates over the height of the steam generator may differ from those which have been described.

Finally, the invention applies not only to steam generators in pressurized water nuclear reactors, but also to other heat exchangers incorporating a tube bundle arranged in a cylindrical tube casing, itself placed inside a rigid cylindrical outer pressurized casing.

What is claimed is:

1. Heat exchanger incorporating a tube bundle (2) arranged in a cylindrical bundle casing (5) held radially inside an outer cylindrical casing (3) and placed coaxially with the latter, a set of spacer plates (8) arranged transversely relative to the bundle (2) inside the casing (5) and spaced along its length and several sets of supporting components (20, 30) fixed integrally to the bundle casing (5), arranged radially at the level of the spacer plates (8) and each inserted between the outer edge of a spacer plate (8) and the inner surface of the outer casing (3), with interposition of wedging means (23, 33) between the spacer plate (8) and the supporting component (20, 30), in which (a) the bundle casing (5) incorporates in its wall openings (14) each corresponding to a supporting component (20, 30), openings, cylindrical sleeves (15, 25) being fixed along the edge of said openings and projecting radially into the space between the bundle casing (5) and the outer wall (3) of the heat exchanger; and (b) each of the supporting components (20, 30) incorporates two cylindrical parts (20*a*, 20*b*-30*a*, 30*b*) having a common axis (XX'), one in extension of the other, including a large-diameter part (20*a*, 30*a*) welded by its outer side surface to the inside of the corresponding sleeve (15, 25) and incorporating a surface for supporting (20*c*, 30*c*) wedging means (23, 33) directed towards the tube bundle (2) and sloping radially relative to the axis XX' of the supporting component (20, 30), and a smaller-diameter part (20*b*, 30*b*) abutting with its end against the inner surface of the outer casing (3) of the heat exchanger.

2. Heat exchanger as claimed in claim 1, incorporating on at least a part of its periphery an intermediate casing (7) arranged between the bundle casing (5) and the outer casing (3) and coaxially with the latter, in which the sleeve (15) fixed integrally to the bundle casing (5) is connected to a sleeve (17) coaxial with the sleeve (15) fixed to the intermediate casing (7) along an opening (16) in the latter and projecting into the space between the bundle casing (5) and the intermediate casing (7), so as to form a passage for the supporting component (20) through the casings (5 and 7) while sealing in a leakproof manner the space between the bundle casing (5) and the intermediate casing (7).

3. Heat exchanger as claimed in claim 1 or 2, wherein the supporting component (20) is a single block.

4. Heat exchanger as claimed in claim 1, incorporating an intermediate casing (7) between the bundle casing (5) and the outer casing (3) coaxial with these casings (3) and (5), in which the supporting component (30) incorporates two independent parts (30*a*) and (30*b*), namely a large-diameter part (30*a*) fixed in the sleeve (25) fixed integrally to the bundle casing (5) and a small-diameter part (30*b*) fixed inside a sleeve (27) coaxial with the sleeve (25) and fixed integrally to the intermediate casing (7), these two independent parts (30*a*) and (30*b*) of the supporting component contacting each other through a plane face perpendicular to their radial supporting axis, when the part (30*b*) bears on the outer casing (3) of the heat exchanger and at least one wedge (33) bearing on the inner face of the large-diameter part (30*a*) of the supporting component (30) is inserted between the outer side surface of the corresponding spacer plate (8) and the supporting component (30) in two parts.

5. Heat exchanger as claimed in claim 1 or 2 which incorporates a set of supporting devices (10,11) equally spaced angularly around each of its spacer plates (8).

6. Heat exchanger as claimed in claim 5, in which the supporting devices forming the various sets, each associated with a spacer plate (8), have widths in the circumferential direction of the spacer plates (8) which can vary depending on the position of the spacer plate with which they are associated, in the heat exchanger, these supporting devices incorporating a number of wedging components (23,33) which is also variable.

* * * * *